US006412541B2

(12) United States Patent
Roesler et al.

(10) Patent No.: US 6,412,541 B2
(45) Date of Patent: Jul. 2, 2002

(54) PROCESS FOR PRODUCING A THERMALLY LOADED CASTING

(75) Inventors: Hans-Joachim Roesler, Braunschweig; Alexander Beeck, Kuessaberg, both of (DE); Peter Ernst, Stadel; Reinhard Fried, Nussbaumen, both of (CH)

(73) Assignee: Alstom Power N.V., Amsterdam (NL)

( * ) Notice: Subject to any disclaimer, the term of this patent is extended or adjusted under 35 U.S.C. 154(b) by 0 days.

(21) Appl. No.: 09/836,297

(22) Filed: Apr. 18, 2001

(30) Foreign Application Priority Data

May 17, 2000 (DE) ..... 100 24 302

(51) Int. Cl.[7] ..... B22C 9/02; B22C 9/00; B22D 7/10; B22D 27/00; B22D 27/04

(52) U.S. Cl. ..... 164/34; 164/516; 164/122.1

(58) Field of Search ..... 164/35, 34, 348, 164/122.1, 122.2, 23, 516

(56) References Cited

U.S. PATENT DOCUMENTS

| | | | | |
|---|---|---|---|---|
| 3,616,841 A | * | 11/1971 | Walz | 164/246 |
| 3,690,367 A | | 9/1972 | Daniels | |
| 3,763,926 A | | 10/1973 | Tschinkel et al. | |
| 4,422,229 A | * | 12/1983 | Sadler et al. | 164/112 |
| 4,653,983 A | | 3/1987 | Vehr | |
| 5,016,702 A | * | 5/1991 | Ahlers | 164/34 |
| 5,511,604 A | | 4/1996 | Ravenhall et al. | |

FOREIGN PATENT DOCUMENTS

| | | |
|---|---|---|
| DE | 1508663 | 6/1970 |
| DE | 2124773 | 12/1971 |
| DE | 2853705 | 6/1979 |
| DE | 3104920 C2 | 1/1982 |
| DE | 3210433 C2 | 10/1982 |
| DE | 3203869 C2 | 8/1983 |
| DE | 3235230 C2 | 3/1984 |
| DE | 3813287 C2 | 12/1988 |
| DE | 3806987 C2 | 9/1989 |
| DE | 4328401 A1 | 3/1995 |
| DE | 19612500 A1 | 10/1997 |
| DE | 19718886 A1 | 11/1998 |
| EP | 0132667 B1 | 10/1987 |
| EP | 0478413 A1 | 4/1992 |
| EP | 0749790 A1 | 12/1996 |
| WO | WO97/19774 | 6/1997 |
| WO | WO98/50186 | 11/1998 |

OTHER PUBLICATIONS

Ein neues Giesstechnisches Herstellungsverfahren fur offenporige Metallschwanne, Grote, et al., Metallschwamme, Giesserei 86 (1999), No. 10, Oct. 12, pp. 75–78.

Syntaktische Schaume auf Magnesiumbasis, Hartmann, Aluminium 75, 1999, pp. 154–156.

Giesstechnische Herstellung von Gradienten–werkstoffen durch kontrollierte Formfullung, Teil 1, Guntner, et al., Aluminium 73, 1997, pp. 531–536.

Zum Stand der Technik des Vollformgiessens von Seriengussteilen in binderfreiem Sand (Lost–Foam–Verfahren) am Biespiel der Saturn–Giesserei, Kuhlgatz, Giesserei 81 (1994), No. 22, Nov. 14, pp. 803–808.

* cited by examiner

*Primary Examiner*—M. Alexandra Elve
*Assistant Examiner*—Kevin McHenry
(74) *Attorney, Agent, or Firm*—Burns, Doane, Swecker & Mathis, L.L.P.

(57) ABSTRACT

A thermally highly loaded casting is produced. The casting mold is produced from a slurry using a wax model and a polymer foam which is fixed to the wax model or has been introduced into a cavity. In this way, during the casting process the liquid superalloy also penetrates into the open-cell structure of the casting mold, so that an integral cooling structure is formed during the solidification of the casting. A single-crystal or directionally solidified casting is advantageously produced. It is also conceivable to vary the cell size of the polymer foam, to produce a cooling structure and a base material separately, and to coat the cooling structure with a ceramic protective layer (thermal barrier coating).

16 Claims, 3 Drawing Sheets

PROCESS FOR PRODUCING A THERMALLY LOADED CASTING

FIELD OF THE INVENTION

Figure 1:
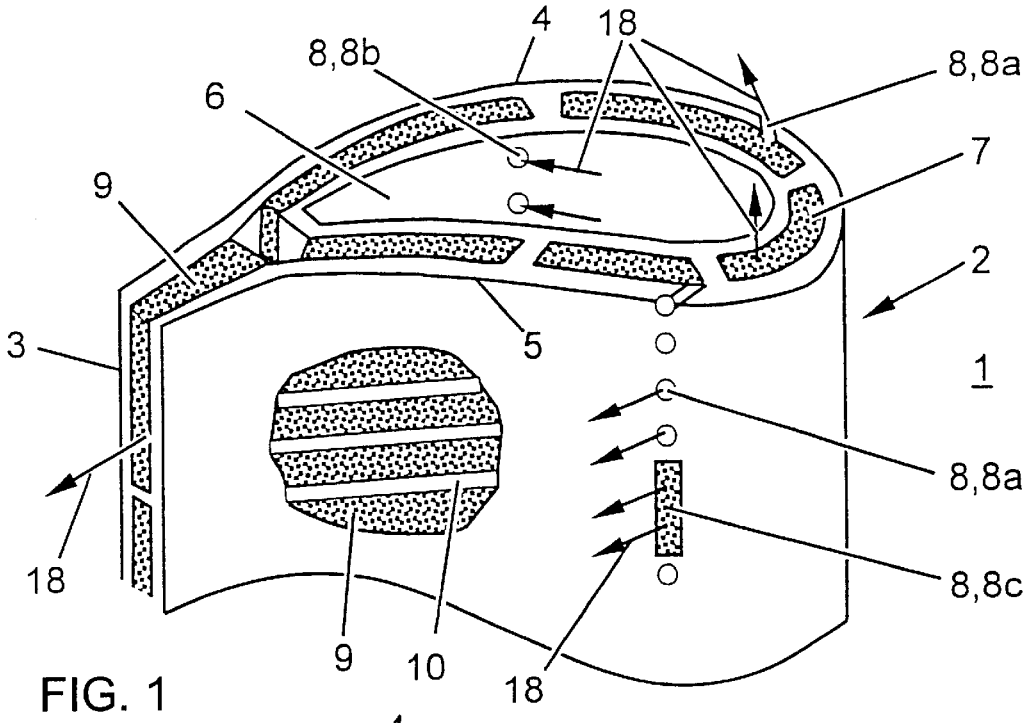

The invention relates to a process for producing a thermally loaded casting of a thermal turbomachine.

BACKGROUND OF THE INVENTION

It has long been known to provide parts of thermal turbomachines which are exposed to hot gas, e.g., turbine blades of gas turbines, with cooling-air bores or with cooling structures, in order to increase the temperature of the hot gas and to extend the service life of the parts in question. The inner side of a cooling system which is of double-walled design and is used for a turbine blade, is cooled by cooling air as a result of the heat being dissipated to the outside. The outer side of the blade is cooled by a film which forms on the surface of the turbine blade. The aim is to make the film cooling as effective as possible and, at the same time, to reduce the amount of cooling air.

Gas turbine blades which operate with film cooling are known, for example, from the publications DE 43 28 401 and U.S. Pat. No. 4, 653, 983.

Furthermore, it is known to use metal felts in turbine blades. This is disclosed, for example, in document DE-C2-32 03 869 or in DE-C2-32 35 230. This use of a metal felt has the task of providing a (internal) cooling system. At the same time, this metal felt can serve as protection against abrasion from external mechanical loads, in particular if it has been arranged on the outer side of the turbine blade and has been coated with a ceramic protective layer. A turbine blade with similar properties is also known from European Document EP-B1-132 667.

However, a less advantageous feature of these blades is that they do not comprise a single part, but rather the metal felt always has to be fitted or applied in a further process step.

The invention is based on the object of providing a process for producing a thermally loaded casting of a thermal turbomachine with an integrated cooling structure which increases the efficiency of the turbomachine. The cooling structure is of the same material as the casting and it is also possible to produce it in a step which is part of the casting process.

SUMMARY OF THE INVENTION

According to the invention, the object is achieved by a process in which a wax model of the part to be cooled is prepared, at least one polymer foam is prepared, which is fixed to the wax model or is introduced into a cavity in the wax model, the at least one polymer foam and the wax model are immersed in a ceramic material, the ceramic material accumulating around the wax model and the polymer foam also being filled with the ceramic material, the ceramic material is dried, so that a casting mold is formed, the wax and the at least one polymer foam are removed by a heat treatment, the casting is produced using the casting mold by a known casting process, and the ceramic material is removed.

In a second embodiment, the object is achieved in a similar way. As a distinguishing factor, however, a ceramic insert is prefabricated from a polymer foam with an open-cell structure. This ceramic insert is attached to the wax model or is introduced into a cavity in the wax model and the casting mold is produced as described above.

To maintain the external mass of the cooling structure, it is advantageously conceivable to use a prefabricated mold in which the polymer foam is foamed. The slurry can be applied to the polymer foam when it is still in the mold. In this way, it is even possible to form complicated three-dimensional forms of the cooling structure. For better drying of the slurry which is still liquid, the material of this mold may also contain a binder.

A prefabricated ceramic insert of this type can be heated considerably before being used for production of the casting mold, in order to achieve a particular strength. It is also conceivable to burn out the polymer foam of the insert prior to application to the wax model.

In a third embodiment, the object according to the invention is achieved by separate production of the casting and the open-cell cooling structure. In a further process step, the two parts are joined to one another by soldering or welding.

Furthermore, it is possible for an open-cell cooling structure which faces outward to be covered with a ceramic protective layer, in order to protect the casting from additional external abrasion and from the hot gases which surround it. Because of the open-cell structure of the metal foam, the ceramic protective layer adheres very well thereto and the possibility of flaking caused by the extreme operating conditions is reduced. In addition, cooling below the ceramic protective layer is still ensured provided that the ceramic protective layer does not penetrate all the way through the cooling structure.

In all the abovementioned embodiments it is advantageously possible to use a polymer foam of variable cell size to cool certain regions of the cooling system to a greater or lesser extent than other regions. The process will advantageously be a casting process for producing a single-crystal or directionally solidified component. The thermally loaded casting may, for example, be a guide vane or a rotor blade, a heat-accumulation segment, a platform for the guide vane or the rotor blade or a combustion-chamber wall of a gas turbine or a rotor blade of a compressor.

BRIEF DESCRIPTION OF THE DRAWING FIGURES

Figure 2:
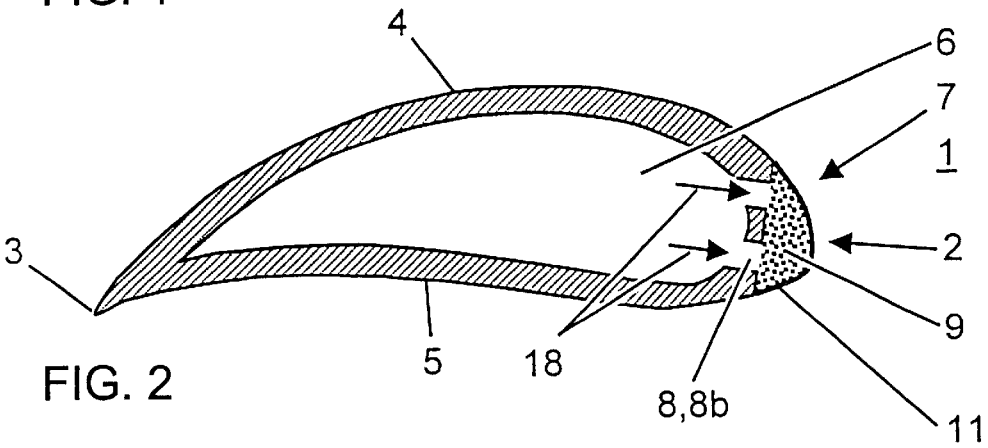
Figure 3:
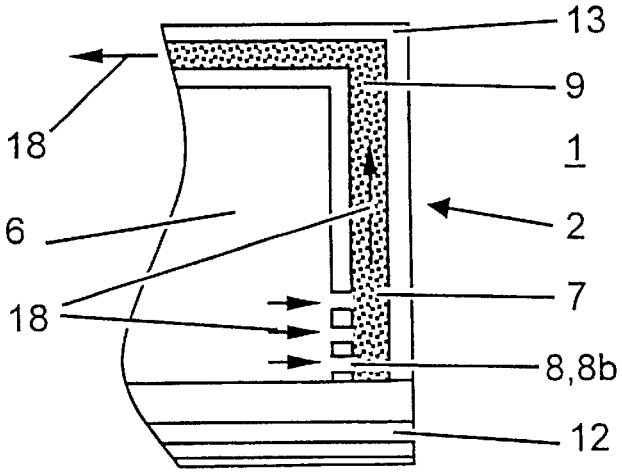
Figure 4:
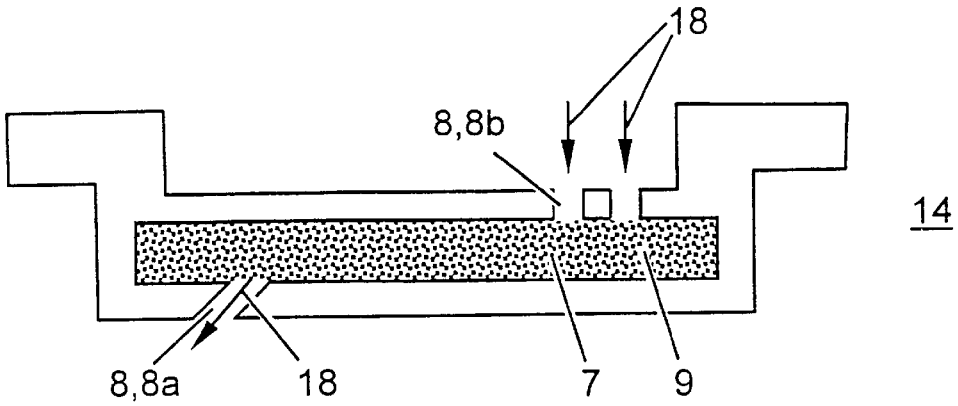
Figure 5:
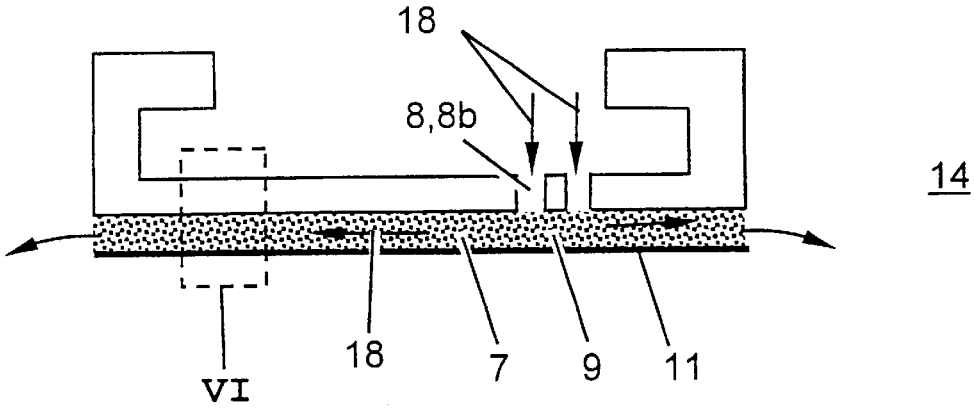
Figure 6A:
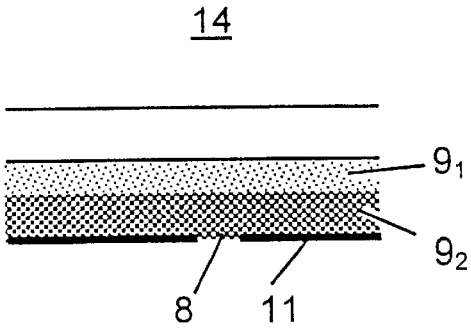
Figure 6B:
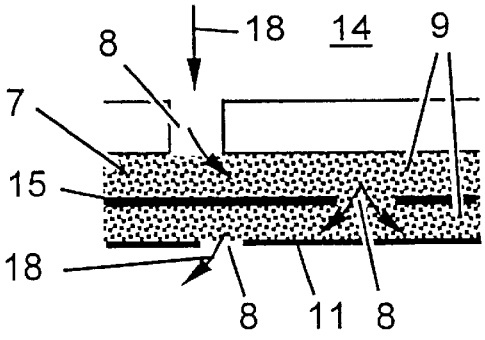
Figure 7:
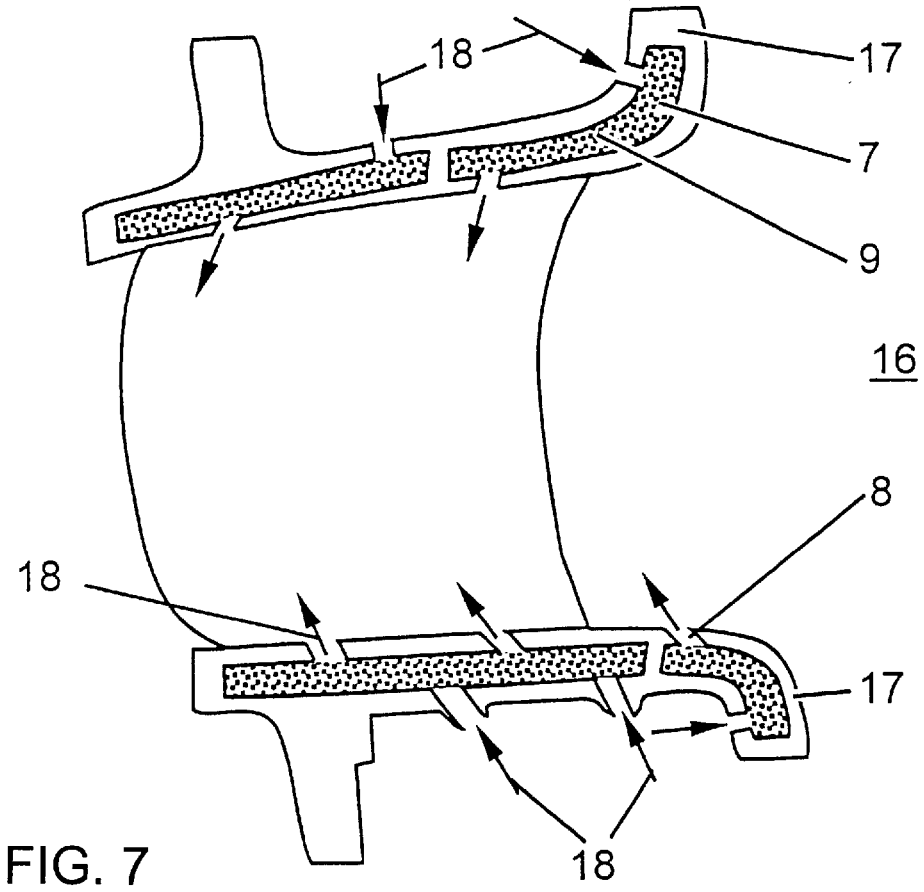
Figure 8:
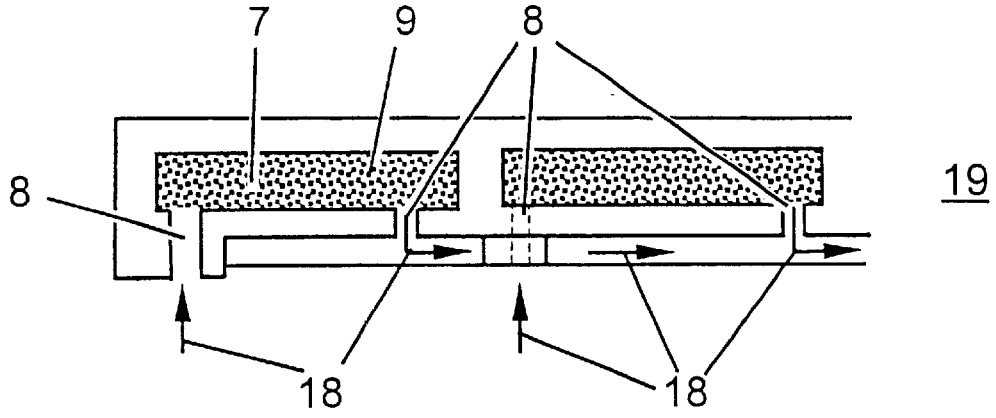

FIG. 1 shows part of a cooled turbine blade which has been produced using the process according to the invention, FIG. 2 shows a cross section through a turbine blade according to the invention, FIG. 3 shows a longitudinal section through a turbine blade according to the invention, FIG. 4 shows a section through an embodiment of a heat shield according to the invention, FIG. 5 shows a section through a second embodiment of a heat shield according to the invention, FIG. 6*a* shows a variation of excerpt VI in FIG. 5, FIG. 6*b* shows a second variation of excerpt VI in FIG. 5, FIG. 7 shows a guide vane according to the invention with cooled platforms, and FIG. 8 shows a cooled wall of a combustion chamber which has been produced using the process according to the invention.

DETAILED DESCRIPTION OF THE INVENTION

Only the elements which are significant to the invention are illustrated. Identical elements are provided with the same reference numerals in different drawings. The direction of flow is indicated by arrows.

The invention relates to a process for producing a thermally loaded casting for a thermal turbomachine. This casting may be, for example: a guide vane or rotor blade of a gas turbine or a compressor, a heat-accumulation segment of a gas turbine, the wall of a combustion chamber, or a similar casting which is subjected to high thermal loads. These castings and the process according to the invention for their production are explained in more detail below with reference to the enclosed figures. A common feature of all these castings is that they need to be cooled on account of the external thermal loading and for this reason include an integrated open-cell cooling system.

The castings are produced using casting furnaces which are generally known from the prior art. A casting furnace of this type can be used to produce components which are of complex design and can be exposed to high thermal and mechanical loads. Depending on process conditions, it is possible to produce the casting in directionally solidified form. It is possible to produce the casting as a single crystal (SX) or in polycrystalline form as columnar crystals which have a preferred direction (directionally solidified, DS). It is particularly important for the directional solidification to take place under conditions in which considerable heat exchange takes place between a cooled part of a casting mold which accommodates molten starting material and the starting material which is still molten. It is then possible for a zone of directionally solidified material to form with a solidification front which, under the ongoing extraction of heat, migrates through the casting mold, forming the directly solidified casting.

The document EP-A1-749 790 has disclosed, by way of example, a process of this type and a device for producing a directionally solidified casting. The device comprises a vacuum chamber which includes an upper heating chamber and a lower cooling chamber. The two chambers are separated by a baffle. The vacuum chamber accommodates a casting mold which is filled with a molten material. To produce thermally and mechanically loadable parts, such as in the case of guide vanes and rotor blades of gas turbines, a nickel-based alloy may be used. In the middle of the baffle there is an opening, through which the casting mold is slowly moved from the heating chamber into the cooling chamber during the process, so that the casting is directionally solidified from the bottom upward. The downward movement takes place by means of a drive rod on which the casting mold is mounted. The base of the casting mold is of water-cooled design. Means for generating and guiding a gas flow are present beneath the baffle. By means of the gas flow next to the lower cooling chamber, these means provide additional cooling and therefore a greater temperature gradient at the solidification front.

A similar process which, in addition to heating and cooling chamber, operates with additional gas cooling, is also known, for example, from the patent U.S. Pat. No. 3,690,367.

A further process for the production of a directionally solidified casting is known from the document U.S. Pat. No. 3,763,926. In this process, a casting mold which has been filled with a molten alloy is immersed continuously in a bath which has been heated to approximately 260° C. The result is a particularly rapid dissipation of heat from the casting mold. This and other similar processes are known under the term LMC (liquid metal cooling).

It is advantageous for the invention to utilize this type of casting furnace to produce single-crystalline or directionally solidified castings, but the invention is not restricted thereto.

The process according to the invention for producing a turbine blade 1, as is shown, for example, in various embodiments in FIGS. 1 to 3, relates to a cooling system 7 which is integrated in the turbine blade 1 and is partially or completely filled with an open-cell metal foam 9. The turbine blade 1 in FIG. 1 has a cavity 6, from which, while the turbomachine is operating, cooling air 18 is passed through inner cooling holes 8, 8*b* into the cooling system 7, which is of double-walled design. The arrows indicate the direction of flow of the cooling air 18. The cooling air 18 then flows both upward inside the turbine blade and onto the rear edge 3 of the turbine blade 7. It is able to leave the cooling system 7 again at the rear edge 3, at outer cooling holes 8, 8*a* or else at larger cooling openings 8, 8*c*, both of which may be present on the front side 2, on the pressure side 4 or on the intake side 5. At the outer cooling holes 8, 8*a*, film cooling is established, while the walls in the interior of the cooling system 7 are cooled by convection. As can be seen at the cut-away section in FIG. 1, depending on the application it is also possible for axial ribs 10 to be present inside the cooling system 7, in which ribs there is no metal foam 9 and in which ribs the cooling air 18 can flow unimpeded.

FIG. 3, which shows the front edge 2 of the blade root 12 through to the blade tip 13 in the form of a longitudinal section through a turbine blade 1 illustrates the direction of flow of the cooling air 18. The cooling air 18 enters the cooling system 7 through inner cooling openings 8, 8*b* of the cavity 6. The cooling air 18 then flows through the cells of the metal foam 9 which is situated inside the cooling system 7.

It is now an object of the invention to manufacture cooling systems 7 of this type which are filled with open-cell metal foam 9 integrally with the overall casting as early as during the casting process, using casting furnaces as have been mentioned above. To do this, a wax model of the part to be cooled is prepared. An open-cell polymer foam, which may, for example, be a polyurethane foam, is fixed to the wax model of the part which is to be cast or is introduced into a cavity which may be present in the wax model. It is also possible to fix together various wax/polymer models to form an overall model. The polymer foam and the wax model are then immersed in a liquid ceramic material, which is also known as a slurry. In the process, not only is the subsequent casting mold for the casting formed around the wax model, but also the ceramic material penetrates into the cells of the polymer foam. The slurry penetrates all the way through the polymer foam, since it is an open-cell foam. The ceramic material is then dried, so that the casting mold, which is used to produce the casting, is formed. After the drying of the slurry, the wax and also the polymer foam are removed by a suitable heat treatment, i.e. are burnt out. In this process step, the casting mold is fired, thereby aquiring the necessary strength. The casting is produced using the casting mold which has been formed in this way by a known casting furnace, which has been described in more detail above, in a known way. Since, during the filling step, the liquid alloy penetrates without problems not only into the casting mold itself but also into the cells which have been formed by the polymer foam and form the subsequent cooling system, the abovementioned metal foam 9 is formed, as cooling system 7, at the same time as the solidification of the alloy. Advantageously, the casting and the metal foam then comprise a single part and there are no further process steps involved in the production of the cooling structure. By virtue of the casting process and the subsequent solidification, this type of production also avoids porosity of the superalloy inside the metal foam 9, since the liquid alloy is distributed uniformly within the open-cell casting mold (formed by the polymer foam) as early as during the filling step.

The ceramic casting mold can then be removed in a suitable way, for example by using an acid or an alkali.

With the process described, it is also possible to create a structure as can be seen in FIG. 2, which diagrammatically depicts a section through a turbine blade 1 according to the invention. In this case, the cooling structure 7 is only present on the front edge 2 of the turbine blade 1. This cooling structure 7 was created, as has already been described above, by simply attaching the polymer foam to the wax model. All the other process steps of the production are the same. In the exemplary embodiment shown in FIG. 2, the cooling air 18 penetrates from the cavity 6, through the cooling holes 8, 8*b*, into the cooling structure 7. The cooling structure 7 itself is coated with a ceramic protective layer 11 (thermal barrier coating, TBC). This takes place, for example, using a plasma spraying process which is known from the prior art or an equivalent coating process.

Naturally, prior to the coating with the TBC from the prior art, a known heat treatment, which is not referred to in more detail here, of the blank casting is required. It is also conceivable for a metallic protective layer, such as MCrAlY, to be applied prior to the coating with TBC, using known means.

The coating of the porous cooling structure 7 with TBC can take place in various ways (by varying the parameters such as spraying angle, spraying distance, spraying particle size, spraying velocity, spraying temperature, etc.). TBC can penetrate all the way through the cooling structure 7, so that the cells of the metal foam 9 are completely filled. Cells allow very good adhesion of the TBC. The cooling structure 7 may also be covered with TBC only in a layer which lies close to the surface, so that beneath the TBC protective layer there is still a layer into which cooling air 18 can penetrate. It is also conceivable for cooling holes 8 to be present inside the protective layer 11, through which the cooling air 18 emerges to the outside. On account of the open-cell structure of the metal foam 9, the ceramic protective layer 11 adheres very well thereto. The adhesion of the ceramic protective layer 11 to the cooling structure can be improved still further by coarsening of the cell size toward the outside (where the protective layer 11 is applied). The flaking of the TBC while the casting is in operation as a result of poor adhesion to the base material is advantageously significantly reduced or prevented.

If the ceramic protective layer 11 is sufficiently porous for it to allow cooling air to pass through to a sufficient extent, there is no need for any external cooling holes. In this way, it is possible to achieve a so-called sweat cooling, which has proven highly effective in terms of its cooling action.

Possible cooling holes 8 inside the ceramic protective layer 11 may be formed as a result of suitable masking taking place prior to the coating with TBC, and unmasking using suitable means taking place thereafter. The masking may, for example, take place using polymer foam which is burnt out for unmasking. A second possibility of masking the surface consists in providing locations which occupy this position inside the casting mold. In this case, the ceramic casting mold at these locations is only removed after coating with TBC.

The production of a metal foam 9, as in FIG. 2, at the outer surface and the additional coating with TBC is appropriate in particular at the locations at which abrasion may occur as a result of a mechanical action, for example at the blade tip of a turbine blade 1 or at a heat-accumulation segment, since the open-cell structure of the metal foam 9 is highly flexible and does not become blocked by the abrasion itself. Overall, however, the abrasion is reduced by the flexibility of the metal foam 9.

In a second embodiment of the process according to the invention, the polymer foam, before it is attached to the wax model or before it is introduced into a cavity which is situated in the wax model, is treated with a slurry, so that a separate model of the cooling structure made from a ceramic material is formed. The polymer foam is immersed in the slurry, so that the cells fill up. This is followed by the obligatory drying of the slurry. When producing this insert, it should be ensured that the size, i.e. the external dimensions, of the polymer foam are not affected or are affected only within narrow tolerance limits. This can also be ensured by foaming the polymer foam in a mold, so that the external dimensions and, under certain circumstances, also a complex three-dimensional shape are fixedly predetermined. It is also conceivable to introduce the slurry into the polymer foam while it is still in this mold. The ceramic model or this insert, as has already been described above, is fixed to the wax model or is introduced into a cavity before the overall casting mold is produced and the wax/polymer foam is burnt out. Optionally, the polymer foam may be burnt out before the attachment or introduction.

The material of the abovementioned mold in which the polymer foam can be foamed in order to maintain the external dimensions can contain a binder for improved drying of the slurry.

An insert of this type can additionally be heated by a heat treatment before being attached to the wax model, which further increases the strength. In the ceramic body, this takes place by means of a sintering operation. Overall, the casting mold becomes stronger and denser.

With the process according to the invention, it is also possible to produce castings as illustrated in FIGS. 4 to 8. FIGS. 4 and 5 show a heat-accumulation segment 14 of a gas turbine. This heat-accumulation segment 1 may have a double-walled cooling structure 7 (FIG. 4) or an externally applied metal foam 9 (FIG. 5), which in a similar way to the turbine blade shown in FIG. 2 may be partially or completely coated with a protective layer 11 of TBC. In both embodiments, cooling air 18 flows through the heat-accumulation segment. This is made possible by the open-cell metal foam 9. The cooling air 18 penetrates through cooling holes 8 into the cooling system 7 and leaves it again through these holes.

FIGS. 6*a*, 6*b* show two variants of the excerpt VI from FIG. 5. As can be seen from FIG. 6*a*, the metal foam 9 can acquire a different cell size by varying the cell size of the polymer foam during the production process. FIG. 6*a* shows the metal foam $\mathbf{9}_1$, $\mathbf{9}_2$ with a variable cell size. This allows greater or lesser cooling of individual regions of the casting. As has already been mentioned above, this is also advantageous for better attachment of the protective layer 11 to the metal foam 9. As described above, the protective layer 11 may also have cooling holes 8 passing through it, through which the cooling air 18 can flow to the outside.

While the casting is in operation, it may be necessary to filter the cooling air, in order to prevent the fine-cell structure from becoming blocked by contaminants which are situated in the cooling air, thus reducing the cooling capacity.

In FIG. 6*b*, which shows a second variant of excerpt VI from FIG. 5, the cooling system 7 comprises a plurality of layers of the metal foam 9, with plates 15 between them. The number of layers of metal foam 9/plate 15 is selected purely by way of example and is dependent on the specific application. Even during production as described above, a plurality of layers of wax/polymer foam are prepared, from which the casting mold for the casting is then produced, as described in more detail above. During production, this leads directly to the exemplary embodiment illustrated in FIG. 6*b*. The cooling air 18 penetrates through the metal foam 9, can flow within a "plane" and can cool by convection or transpiration. Although the various planes are separated by the plates 15, there are cooling holes 8 through which the cooling air 18 can change plane. Generally, the specific design of this cooling system 7 is, of course, dependent on the individual case. The cooling holes 8 within the plates 15 are likewise formed as early as during production.

The statements which have been made also apply to the guide vane 16 which is illustrated in FIG. 7 and has two cooled platforms 17, and the combustion-chamber wall 19 which is shown in FIG. 8 and is likewise cooled. Further exemplary embodiments, which are not illustrated by figures, include the cooled castings (blades etc.) of a compressor.

The castings with an integrated, open-cell cooling system 7 which are produced using the process according to the invention are also advantageous because the pressure difference in the cooling medium between the external pressure and the internal pressure (inside the cavity 6) has a considerable influence on the efficiency of cooling. This pressure difference can be set and controlled very accurately by suitably selecting the cells (distribution, size, etc.) of the metal foam 9.

As a third exemplary embodiment of the process according to the invention, the casting and the porous cooling structure 7 can be produced by separate casting processes and can subsequently be joined together by soldering or welding. The porous cooling structure 7 is produced by the abovementioned polymer foam and the slurry, if appropriate using a mold.

While the present invention has been described by reference to the above-mentioned embodiments, certain modifications and variations will be evident to those of ordinary skill in the art. Therefore the present invention is to be limited only by the scope and spirit of the appended claims.

What is claimed is:

1. A process for producing a thermally loaded casting of a thermal turbomachine having an integrated cooling structure and being produced using a casting mold, wherein the process comprises:

(a) preparing a wax model of the part to be cooled, (b) preparing at least one polymer foam, and fixing the foam to the wax model or introducing the foam into a cavity in the wax model, (c) immersing the at least one polymer foam and the wax model in a slurry of ceramic material, the ceramic material accumulating around the wax model and filling the polymer foam, (d) drying the ceramic material, (e) removing the wax and the at least one polymer foam by a heat treatment to produce the casting mold, (f) introducing molten alloy material into the casting mold, and (g) removing the ceramic material.

2. A process for producing a thermally loaded casting of a thermal turbomachine having an integrated cooling structure and being produced using a casting mold, wherein the process comprises:

(a) preparing a w ax model of the part to be produced, (b) attaching a prefabricated ceramic insert with an open-cell structure to the wax model, or introducing a prefabricated ceramic insert into a cavity in the wax model, (c) immersing the wax model together with the insert in a slurry ceramic material, (d) drying the ceramic material, (e) removing the wax by a heat treatment to produce a casting mold, (f) introducing molten alloy material into the casting mold, and (g) removing the ceramic material of the casting mold.

3. The process as claimed in claim 2, wherein the ceramic insert is heated before being used in step (b) of claim 2.

4. The process as claimed in claim 2, wherein the open-cell structure of the prefabricated ceramic insert is produced by a polymer foam, the polymer foam being immersed in a slurry of ceramic material, so that the cells in the polymer foam are filled with the ceramic material and the ceramic material is then dried and fired.

5. The process as claimed in claim 4, wherein the polymer foam is removed by a heat treatment before use in process step (b) of claim 2.

6. The process as claimed in claim 4, wherein the open-cell structure of the prefabricated ceramic insert is produced by a polymer foam which is introduced into a prefabricated mold and is then filled with the slurry of ceramic material either in the mold or separately from the mold.

7. The process as claimed in claim 6, wherein the material of the prefabricated mold contains a binder.

8. A process for producing a thermally loaded casting, the thermally loaded casting having an integrated cooling structure produced using a casting mold, wherein the process comprises:

(a) producing a casting using a casting mold, (b) producing a porous cooling structure separately from the casting by means of a casting mold which is formed by a porous polymer and a ceramic material, and (c) joining the casting and the cooling structure to one another by soldering or welding.

9. The process as claimed in claim 1, wherein an open-cell cooling structure which faces outward and is situated on the casting is coated with a ceramic protective layer.

10. The process as claimed in claim 9, wherein the ceramic protective layer penetrates all the way through the cooling structure or the cooling structure is only coated with the protective layer close to the surface.

11. The process as claimed in claim 10, wherein locations on the surface of the casting at which cooling holes are to be formed are masked prior to the coating with a ceramic protective layer, and these locations are unmasked again after the coating step.

12. The process as claimed in claim 1, wherein a plurality of layers of the polymer foam and the wax are present, which serve to produce open-cell cooling structures which are separated from one another by plates.

13. The process as claimed in claim 1, wherein the polymer foam has a variable cell size.

14. The process as claimed in claim 1, wherein the polymer foam is a polyurethane foam.

15. The process as claimed in claim 1, wherein a casting process is used to produce single-crystal or directionally solidified castings.

16. The process as claimed in claim 1, wherein the thermally loaded casting comprises: a guide vane or a rotor blade, a heat-accumulation segment, a platform for the guide vane or rotor blade, a combustion-chamber wall of a gas turbine or a guide vane or rotor blade of a compressor.

* * * * *